US007228646B1

(12) United States Patent
Purcell

(10) Patent No.: US 7,228,646 B1
(45) Date of Patent: Jun. 12, 2007

(54) ARTICLE DRYING SUPPORT APPARATUS

(76) Inventor: Donna W. Purcell, 8200 Montgomery Ridge Rd., Belews Creek, NC (US) 27009

( * ) Notice: Subject to any disclaimer, the term of this patent is extended or adjusted under 35 U.S.C. 154(b) by 0 days.

(21) Appl. No.: 11/351,481

(22) Filed: Feb. 13, 2006

(51) Int. Cl.
*F26B 19/00* (2006.01)

(52) U.S. Cl. ..... 34/90; 34/104; 34/201

(58) Field of Classification Search ..... 34/90, 34/60, 80, 103, 104, 201
See application file for complete search history.

(56) References Cited

U.S. PATENT DOCUMENTS

D335,008 S * 4/1993 Abel ..... D32/36
5,276,979 A 1/1994 Gordon, Sr.
5,365,675 A 11/1994 Shabram, Jr.
5,519,949 A * 5/1996 Gibson, Jr. ..... 34/600
6,067,729 A 5/2000 Willis
6,543,630 B2 * 4/2003 Hope ..... 211/133.5
D475,821 S 6/2003 DesForges
6,732,447 B2 5/2004 Tomasi et al.
6,785,924 B1 9/2004 Rogers et al.

* cited by examiner

*Primary Examiner*—S. Gravini

(57) ABSTRACT

An article drying support apparatus includes a perimeter wall defining a housing and enclosing an interior space. The perimeter wall includes a backside having an elongated slit therein defining an opening extending into the interior space. The perimeter wall comprises an air permeable material. A coupler is attached to the perimeter wall and is configured to attach the perimeter wall to an inside surface of a dryer door. A wet item may be positioned within the interior space and held against the dryer door when a clothes dryer is being operated.

11 Claims, 5 Drawing Sheets

ARTICLE DRYING SUPPORT APPARATUS

BACKGROUND OF THE INVENTION

1. Field of the Invention

The present invention relates to drying support devices and more particularly pertains to a new drying support device for securing an article to be dried within a clothes dryer to prevent damage to the article.

2. Description of the Prior Art

The use of drying support devices is known in the prior art. While these devices fulfill their respective, particular objectives and requirements, the need remains for a device that positions an article to be dried in a secured position against a clothes dryer door. This will allow the clothes dryer to be used in a conventional manner while preventing damage to the article in question that is secured to the dryer door.

SUMMARY OF THE INVENTION

The present invention meets the needs presented above by generally comprising a perimeter wall defining a housing and enclosing an interior space. The perimeter wall includes a backside having an elongated slit therein defining an opening extending into the interior space. The perimeter wall comprises an air permeable material. A coupler is attached to the perimeter wall and is configured to attach the perimeter wall to an inside surface of a dryer door. A wet item may be positioned within the interior space and held against the dryer door when a clothes dryer is being operated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
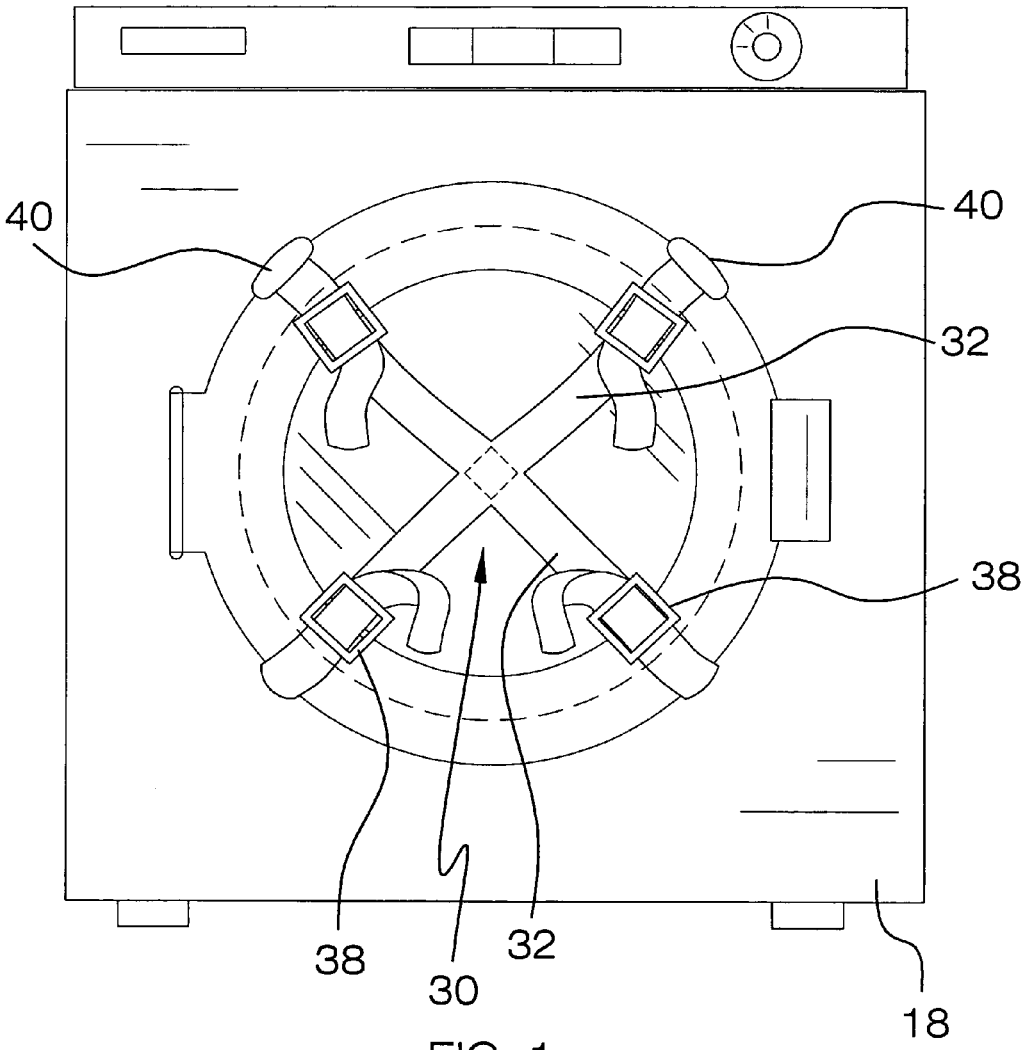
FIG. 1 is a front view of an article drying support apparatus according to the present invention.
Figure 2:
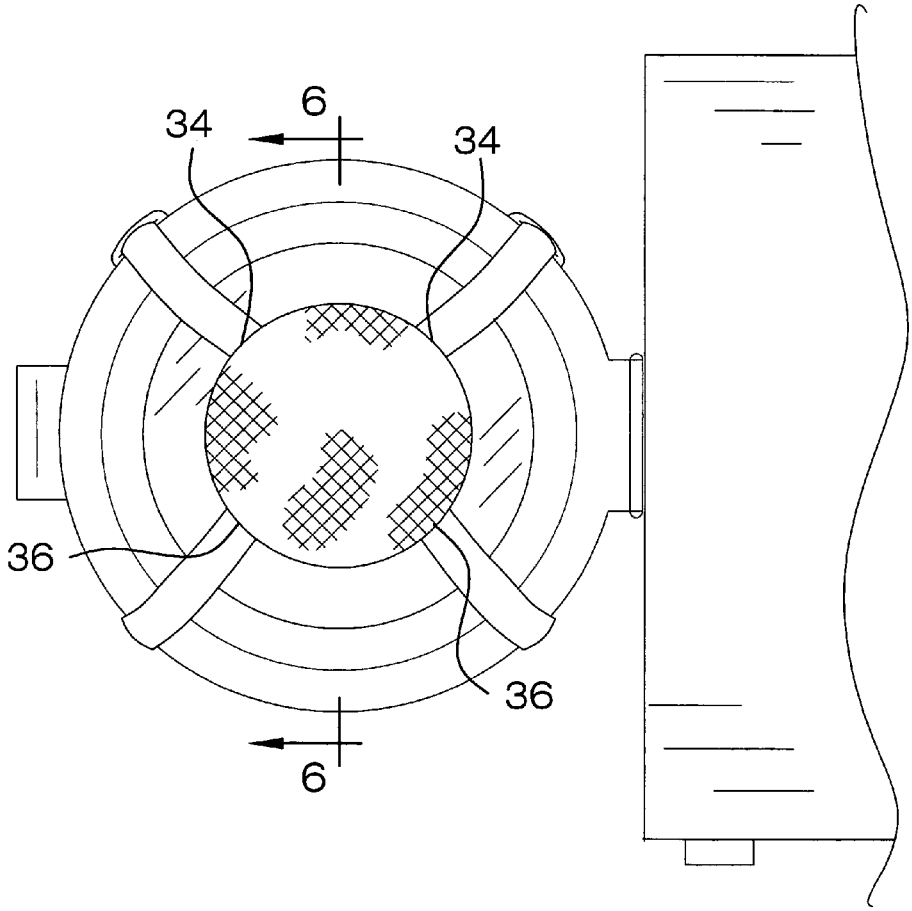
FIG. 2 is a back view of the present invention.

With reference now to the drawings, and in particular to FIGS. 1 through 7 thereof, a new drying support device embodying the principles and concepts of the present invention and generally designated by the reference numeral 10 will be described.

As best illustrated in FIGS. 1 through 7, the article drying support apparatus 10 generally comprises an article holding assembly configured to secure an article to an inside surface 14 of a dryer door 12 attached to a clothes dryer 18. The apparatus 10 includes a perimeter wall 20 defining a housing and enclosing an interior space 22. The perimeter wall 20 includes a backside 24 having an elongated slit 26 therein defining an opening extending into the interior space 24. Flaps 28 overlap on either side of the slit 26 to close the slit 26. The perimeter wall 20 comprises an air permeable material. The perimeter wall 20 is preferably rounded along its outer edge to prevent it being caught on items positioned within the clothes dryer 18.

A coupler 30 is attached to the perimeter wall 20 and is configured to attach the perimeter wall 20 to the inside surface of the dryer door 12. The slit 26 is abutted against the inside surface 14 when the perimeter wall 20 is attached to the dryer door 12 with the coupler 30. The coupler 30 includes a pair of straps 32 each having a first end 34 and a second end 36. Each of the first 34 and second 36 ends is attached to the perimeter wall 20. The straps 32 each extend over the backside 24 of the perimeter wall 20. Each of the straps 32 is extended around the dryer door 12 and releasably attaches the perimeter wall 20 to the dryer door 12. Each of the straps 32 includes an adjustment member 38 configured to allow selective adjustment of the straps 32. The adjustment member 38 of each of the straps is abutted against an outside surface 16 the dryer door 14.

Figure 4:
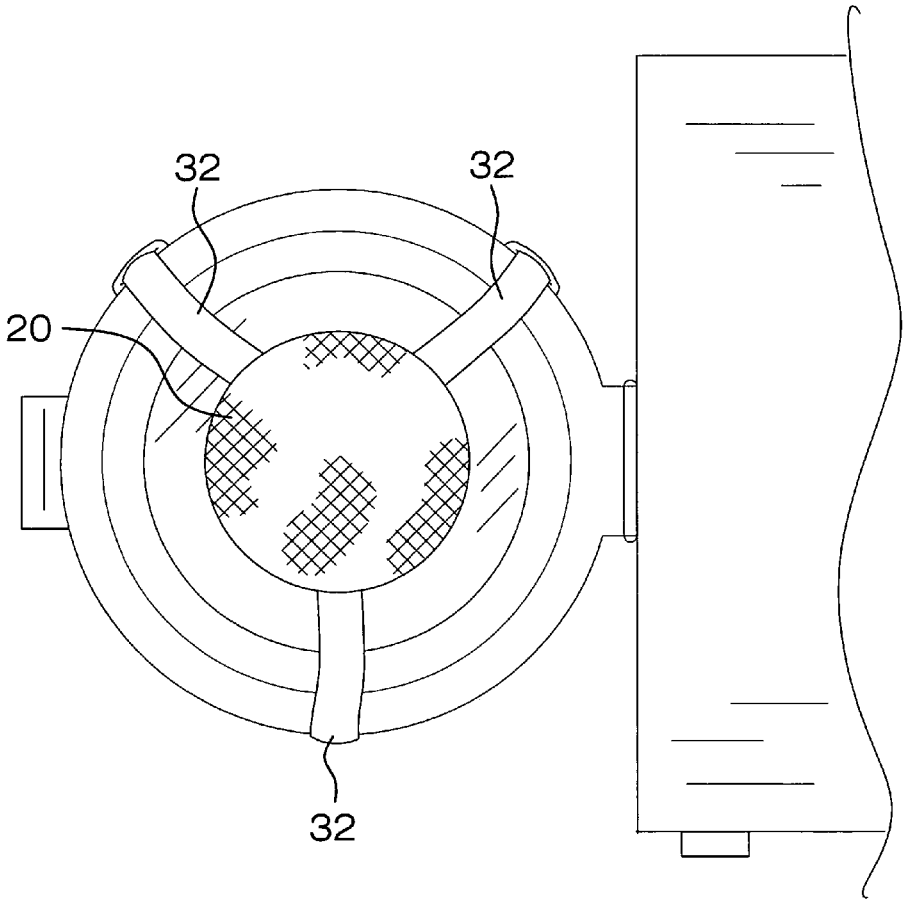
FIG. 4 is a back view of a second embodiment of the present invention.
Figure 5:
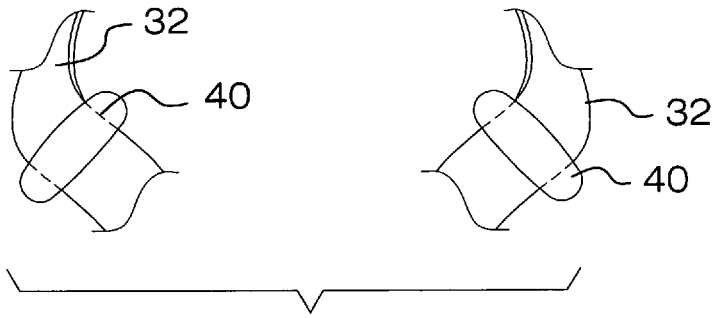
FIG. 5 is a perspective and enlarged view of stops of the present invention.
Figure 3:
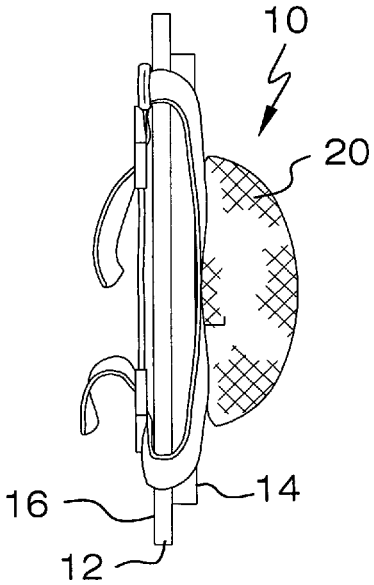
FIG. 3 is a side view of the present invention.
Figure 6:
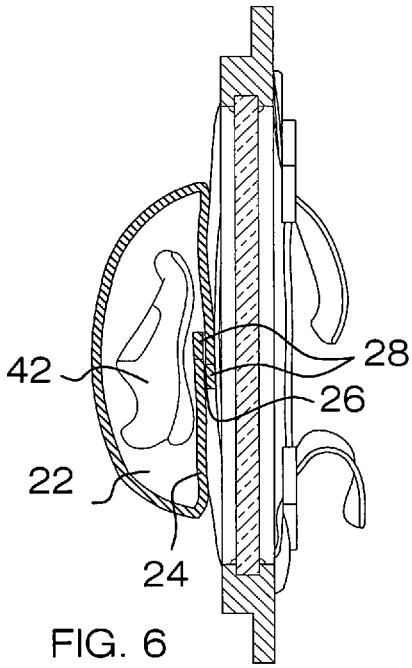
FIG. 6 is a cross-sectional view taken along line 6—6 of FIG. 2 of the present invention.
Figure 7:
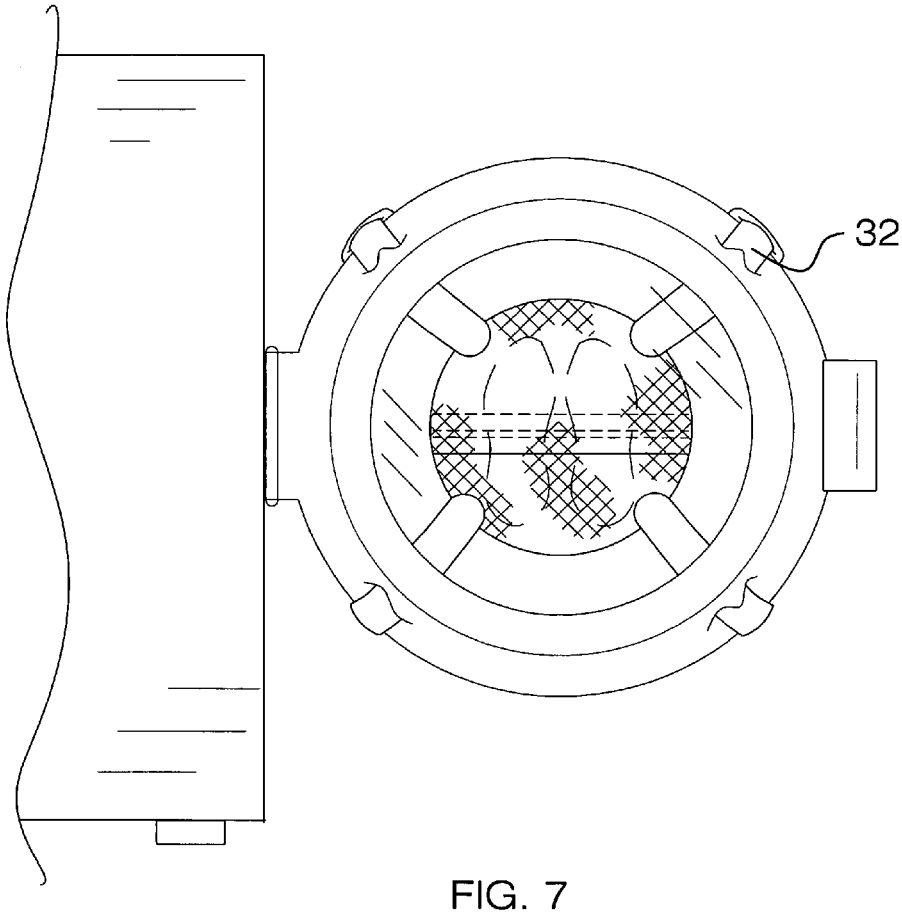
FIG. 7 is a broken front view of the present invention.

FIG. 4 shows a second embodiment including three straps 32 each having a first end 34 attached to the perimeter wall 20 and a second end, not shown, attached together to define a three-point harness.

A plurality of stops 40 is provided. Each of the stops 40 is positioned on one of the straps 32 so that each of the straps 40 has one of the stops 40 positioned thereon. Each of the stops 40 is frictionally coupled to and selectively positionable on an associated one of the straps 32. The straps 32 extend through the stops 40 so that the stops 40 are slidable on the straps 32. The stops 40 are positioned adjacent to a peripheral edge of the dryer door 12 to inhibit movement of the straps 40 on the dryer door 12 and to prevent the perimeter wall 20 from sliding down the dryer door 12.

In use, a wet item 42 may be positioned within the interior space 22 and held against the dryer door 12 when the clothes dryer 18 is being operated. The perimeter wall 12 prevents the movement of the items 42 therein so that the clothes dryer does not damage them. The items 42 may include shoes, baseball caps, delicate clothing and other such articles.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An article holding assembly securing an article to an inside surface of a dryer door attached to a clothes dryer, said assembly comprising:

a perimeter wall defining a housing and enclosing an interior space, said perimeter wall including a backside having an elongated slit therein defining an opening extending into said interior space, said perimeter wall comprising an air permeable material;

a coupler being attached to said perimeter wall and attaching said perimeter wall to the inside surface of the dryer door, said slit abutting the inside surface of said door; and wherein a wet item may be positioned within said interior space and held against the dryer door when the clothes dryer is being operated.

2. The assembly according to claim 1, wherein said coupler includes a pair of straps, each of said straps having a first end and a second end, each of said first and second ends being attached to said perimeter wall, said straps each extending over said backside of said perimeter wall, each of said straps being extended around the dryer door and releasably attaching said perimeter wall to the dryer door, said straps crossing each other over an outside surface of the dryer door, said straps being attached to each other where said straps cross over each other.

3. The assembly according to claim 2, wherein each of said straps includes an adjustment member allowing selective adjustment of said straps.

4. The assembly according to claim 3, wherein said adjustment member of each of said straps is abutted against the outside surface of the dryer door.

5. The assembly according to claim 2, further including a plurality of stops, each of said stops being positioned on one of said straps, wherein each of said straps has one of said stops positioned thereon, each of said stops being frictionally coupled to and selectively positionable on an associated one of said straps, said stops being positioned adjacent to a peripheral edge of the dryer door and inhibiting movement of said straps on the dryer door.

6. An article holding assembly securing an article to an inside surface of a dryer door attached to a clothes dryer, said assembly comprising:

a perimeter wall defining a housing and enclosing an interior space, said perimeter wall including a backside having an elongated slit therein defining an opening extending into said interior space, said perimeter wall comprising an air permeable material;

a coupler being attached to said perimeter wall and attaching said perimeter wall to the inside surface of the dryer door, said slit being abutted against the inside surface when said perimeter wall is attached to the dryer door, said coupler including a pair of straps, each of said straps having a first end and a second end, each of said first and second ends being attached to said perimeter wall, said straps each extending over said backside of said perimeter wall, each of said straps being extended around the dryer door and releasably attaching said perimeter wall to the dryer door, each of said straps including an adjustment member allowing selective adjustment of said straps, said adjustment member of each of said straps being abutted against an outside surface of the dryer door; and a plurality of stops, each of said stops being positioned on one of said straps, wherein each of said straps has one of said stops positioned thereon, each of said stops being frictionally coupled to and selectively positionable on an associated one of said straps, said stops being positioned adjacent to a peripheral edge of the dryer door and inhibiting movement of said straps on the dryer door; and wherein a wet item may be positioned within said interior space and held against the dryer door when the clothes dryer is being operated.

7. An article holding assembly securing an article to an inside surface of a dryer door attached to a clothes dryer, said assembly comprising:

a perimeter wall defining a housing and enclosing an interior space, said perimeter wall including a backside having an elongated slit therein defining an opening extending into said interior space, said perimeter wall comprising an air permeable material;

a coupler being attached to said perimeter wall and attaching said perimeter wall to the inside surface of the dryer door, said coupler including a plurality of straps each being extended around the dryer door, said plurality of straps including at least three straps, each of said straps being attached to said perimeter wall, said straps being spaced from each other on said perimeter wall, each of said straps having a terminal end, each of the terminal ends being attached to each other and positioned in abutment with an outer surface of the dryer door when said perimeter wall is in abutment with the inner surface of the dryer door, angles formed by adjacent ones of said straps extending outwardly from said terminal ends being greater than 30 degrees; and wherein a wet item may be positioned within said interior space and held against the dryer door when the clothes dryer is being operated.

8. The assembly according to claim 7, wherein said slit is abutted against the inside surface when said perimeter wall is attached to the dryer door.

9. The assembly according to claim 7, wherein each of said straps includes an adjustment member allowing selective adjustment of said straps.

10. The assembly according to claim 9, wherein said adjustment member of each of said straps is abutted against an outside surface of the dryer door.

11. The assembly according to claim 2, further including a plurality of stops, each of said stops being positioned on one of said straps, wherein each of said straps has one of said stops positioned thereon, each of said stops being frictionally coupled to and selectively positionable on an associated one of said straps, said stops being positioned adjacent to a peripheral edge of the dryer door and inhibiting movement of said straps on the dryer door.

* * * * *